US007131789B2

(12) United States Patent
Walton

(10) Patent No.: US 7,131,789 B2
(45) Date of Patent: Nov. 7, 2006

(54) OBJECT RETRIEVAL SYSTEM

(76) Inventor: Derek Elliott Walton, 6343 Binder Dr., Colorado Springs, CO (US) 80922

( * ) Notice: Subject to any disclaimer, the term of this patent is extended or adjusted under 35 U.S.C. 154(b) by 205 days.

(21) Appl. No.: 10/863,036

(22) Filed: Jun. 7, 2004

(65) Prior Publication Data

US 2005/0272535 A1 Dec. 8, 2005

(51) Int. Cl.
*A63B 57/00* (2006.01)
*A63B 69/36* (2006.01)

(52) U.S. Cl. ..... 405/60; 405/64; 405/74; 473/197; 473/476; 473/131; 473/409

(58) Field of Classification Search ..... 405/15, 405/16, 53, 60, 63, 67, 74; 4/498, 501, 504; 473/157, 197, 167–169, 476, 131, 409
See application file for complete search history.

(56) References Cited

U.S. PATENT DOCUMENTS 3,921,757 A * 11/1975 Kennedy ..... 182/48
5,240,246 A * 8/1993 Gohil et al. ..... 473/197
6,161,988 A 12/2000 Pawluk
6,447,205 B1 9/2002 Pawluk
2002/0124304 A1 * 9/2002 Perrier ..... 4/504

FOREIGN PATENT DOCUMENTS

DE 4136976 * 5/1993 ..... 4/498

* cited by examiner

*Primary Examiner*—Frederick L. Lagman
(74) *Attorney, Agent, or Firm*—Craig R. Miles; CR Miles, P.C.

(57) ABSTRACT

An object retrieval system providing an expanse of flexible material variably configured by travel of a material support element between a first position and a second position which generates movement in objects that collect on the material surface for retrieval.

5 Claims, 4 Drawing Sheets

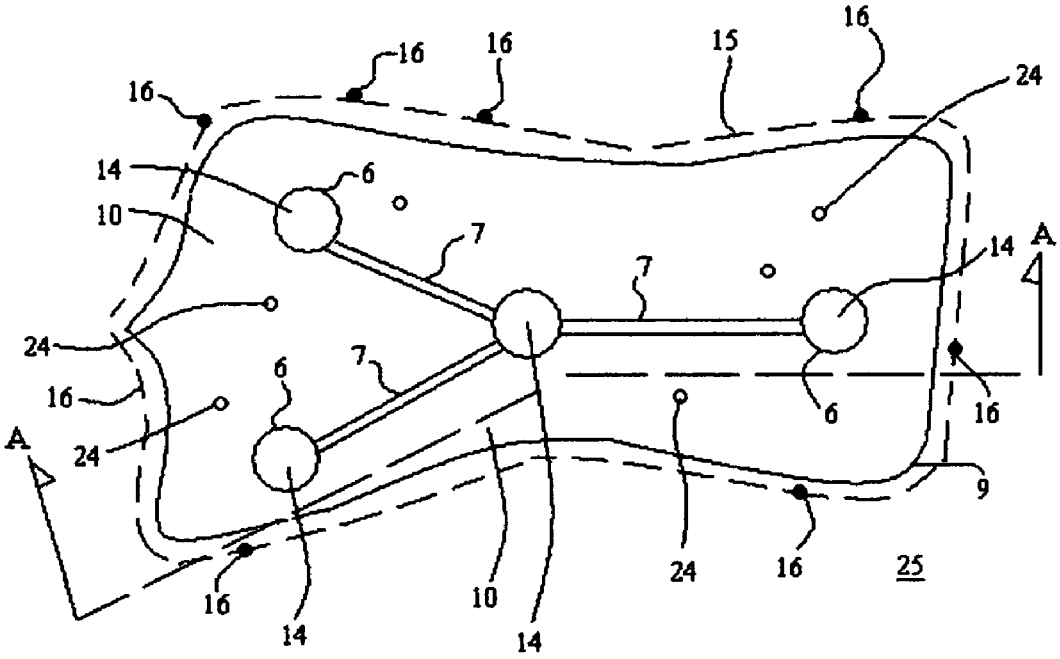
FIG. 1A
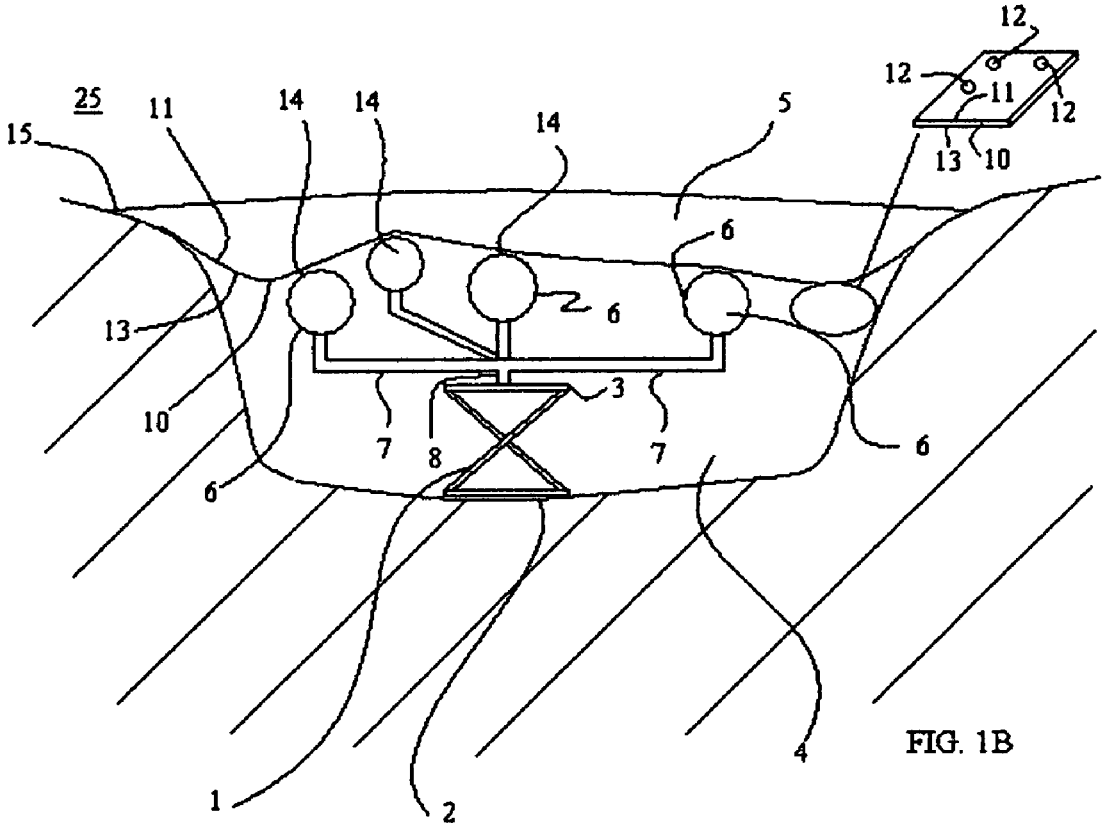
FIG. 1B
FIG. 1

OBJECT RETRIEVAL SYSTEM

I. BACKGROUND

An object retrieval system providing an expanse of flexible material variably configured by travel of a material support element between a first position and a second position which generates movement in objects that collect on the material surface for retrieval.

There are a variety of circumstances under which objects collect within a particular area and must be retrieved. Retrieval of these objects can be time consuming and expensive due to the number of objects, the amount of objects that collect, or the nature of the typography in which the objects collect. As but one non-limiting example, a significant problem for golf courses can be that golf balls collect in water traps. A conventional manner of retrieving the golf balls and other debris that falls into these water traps can be to periodically hire divers. The divers manually collect the submerged golf balls and debris by hand.

Specifically, with respect to utilizing divers to retrieve objects from water traps or pond, a significant problem can be that the process is time consuming and expensive. Divers must be specially trained to work underwater which commands greater pay than for grounds keepers. The golf balls or other debris which collects at the bottom of the water trap or pond must be retrieved by hand. Moreover, this type of work can be more hazardous than routine grounds keeping activities. Additionally, the collection of golf balls or other objects from water traps or ponds can be motivated by the value of the golf balls or other objects which can be recovered. However, collection of golf balls manually from the bottom of a water trap or pond can exceed the value of the recovered golf balls or other ojects.

Another manner of retrieving golf balls and debris from water traps in golf course is to submerge a net under the surface of the water and periodically lift the net above the surface of the water with an inflatable device as described in U.S. Pat. No. 6,447,205 or with a lift device such as that shown in U.S. Pat. No. 6,161,988.

A significant problem with either of these methods can be that the net has fixed securement to a portion of the lift or inflatable device. As the portion of the lift or inflatable device travels from a first position to a second position the net can become unequally tensioned across the surface. This unequal tensioning can lead to a failure of the device to move objects and debris toward the secured perimeter for a variety of reasons. In certain cases, the net can be torn because fixed securement of the lift device to the net creates localized tension in the net that cannot otherwise be released. In other cases, the secured perimeter of the net comes undone and the net loses tension sufficient to maintain a surface on which objects or debris can travel to the perimeter. Finally, the travel of the lift may be restricted to prevent damage to the net resulting in insufficient elevation in portions of the net to allow travel of objects toward the secured perimeter.

The instant invention provides an object retrieval system which addresses each of the above-described problems.

II. SUMMARY OF THE INVENTION

Accordingly, a broad objective of the invention can be to provide an object retrieval system having an expanse of flexible material variably configured by travel of a material support element between a first position and a second position which generates movement in objects that collect on the material surface for retrieval.

Another broad objective of the invention can be to configure the surface of such flexible material while disseminating forces generated in the material during lifting to reduce or eliminate localized tension in the flexible material to avoid excess wear or to avoid tearing the flexible material.

Another significant object of the invention can be to eliminate disruption of the secured perimeter of the flexible material by disseminating forces transmitted toward the perimeter of the flexible material.

Another significant object of the invention can be to provide a flexible material support surface that can be elevated to configure the flexible material in a manner which allows objects to move toward the secured perimeter without being fixed at a single location on the flexible material.

Another significant object of the invention can be to provide a slide surface over which the flexible material travels during travel of the flexible material support from a first elevation to a second elevation.

Another significant object of the invention can be to provide support surface extensions to further support the flexible material which accommodate lateral travel of the flexible material support element during travel from a first elevation to a second elevation.

Naturally, further objects of the invention are disclosed throughout other areas of the specification, drawings, and claims.

III. A BRIEF DESCRIPTION OF THE DRAWINGS

FIG. 1*a* shows a top view of an embodiment of the invention providing a plurality of material support elements configured to lift a flexible material encompassed by an irregular boundary.

FIG. 1*b* provides a cross section AA through FIG. 1*a* which shows an embodiment of the invention providing a plurality of material support elements configured to lift a flexible material encompassed by an irregular boundary.

IV. DETAILED DESCRIPTION OF THE PREFERRED EMBODIMENTS

Figure 2:
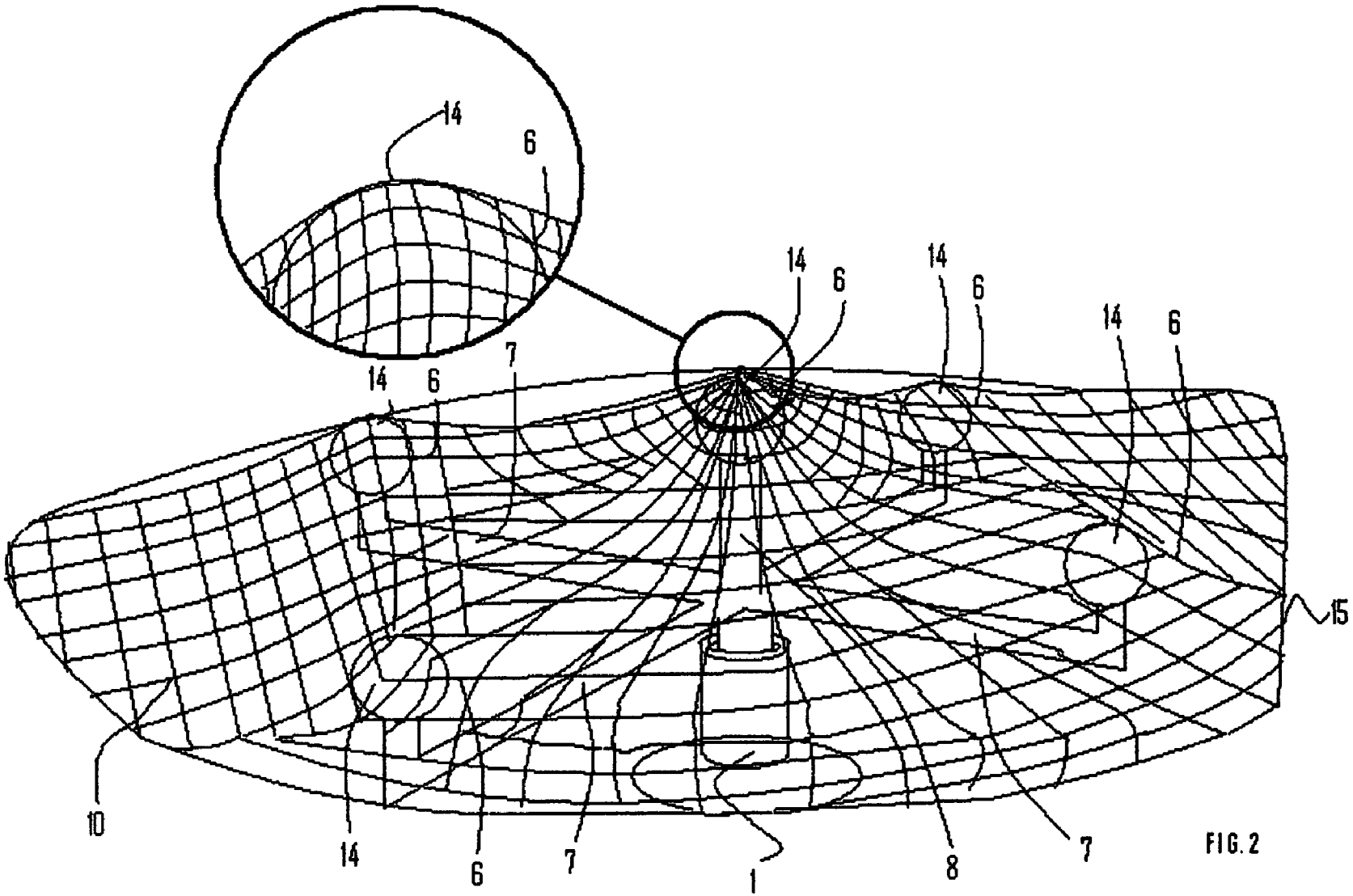
FIG. 2 shows an embodiment of the invention which includes a material slide surface slidly engaged to a portion of the surface of a flexible material.

An object retrieval system providing an expanse of flexible material variably configured by travel of a material support element between a first position and a second position which generates movement in objects that collect on the material surface for retrieval.

First referring primarily to FIGS. 1*a* and 1*b*, which provide a non-limiting example of an embodiment of the object retrieval system invention, a lift means (1) can be located on a support surface (2). The lift means can comprise any device having at least one positionable surface (3) which travels between a first position and a second position. For example, the lift means (1) can be a scissor lift, whether single or double scissor; a cantilevered lift; lift table; single or multiple stage piston, whether pneumatic, hydraulic, gas spring; or the like. The lift means (1) can be located on any manner of support surface (2) which allows the positionable surface to travel in the desired direction between a first position and a second position. As such, the support surface (2) can be the earth; or can be a pad, platform, or other construct established on the earth which provides a surface to which the lift means can be coupled and allows travel of the positionable surface (3) between a desired first position and second position.

The support surface can be located numerous and varied locations as necessary or desired to retrieve, recover, or move objects to which the invention is operably engaged. As shown by FIG. 1*b* the invention can be located on a support surface (2) at the bottom of a hollow (4) which may be filled with a liquid (5) such as water. However, it is not intended that location of the invention be limited to the bottom of a hollow (4) or the bottom of a pond. The object retrieval system in accordance with the invention can have any geographic location in which there is utility for the invention which, by way of example, could be on a substantially flat surface, whether outside or inside a building to move at least one object from a first location to a second location; at a location where objects collect due to the force of gravity to relocate objects to a desired location from the collection location; in a thicket or in other terrain from which retrieval of objects by a person is impeded or time consuming; in a containment vessel from which objects must be retrieved, recovered, or moved.

As shown by FIGS. 1*a*, 1*b*, and 2, the invention can further include at least one material support element (6) responsive to the lift surface (3) which travels between a first position and a second position. A plurality of material support elements (6) can be responsive to the lift surface (3) by providing each with a corresponding extension element (7) established between the lift surface (3) and each material support element (6). As shown by FIGS. 1*a*, 1*b*, and 2, each extension element (7) can project radially about the longitudinal axis of a central hub (8) to the desired location of the material support element (6). As shown by FIG. 1, length and direction of each extension element (7) can vary depending upon the corresponding location of the material support element (6). For example, where the lift (1) has a location on a support surface (2) at the bottom of a hollow, the hollow perimeter (9) (shown in FIG. 1) may dictate the number and location of material support elements (6).

Again referring primarily to FIG. 1*b*, as the lift surface (3) travels between the first position and the second position the material support element(s) (6) correspondingly travel(s) between a first elevation and a second elevation. The distance traveled between the first position and the second position can be adjusted in accordance with the circumstances in which the invention operates. If for example, the material support elements operate between a first position submerged beneath the surface of a liquid (5) and a second position above the surface of the liquid (5), the distance traveled may be between about one foot and about six feet. Alternately, if the invention has a location in a building on a substantially level support surface (2), then the distance traveled between the first position and the second position may be between about 1 foot and about 2 feet. However, the Figures are not intended to limit the amount of distance traveled by the material support elements (6) between the first position and the second position but rather are intended to be illustrative of the numerous and varied applications in which the invention can be utilized.

Again referring primarily to FIG. 1*b*, the object retrieval system in accordance with the invention can further include a flexible material (10) which engages a portion of the material support element (6). The flexible material (10) can be any manner of material which has sufficient flexure to allow travel of the material support element (6) from the first position to the second position while engaged with a first surface (11) of the flexible material (10). The flexible material (10) can further have perforations (12) which communicate between the first surface (11) of the flexible material (10) and the second surface (13) of the flexible material (10). In certain embodiments of the invention, the perforations (12) or apertures can encompass the majority of the surface area of the flexible material (6) such as when the flexible material comprises a net, a web, a mesh, or the like. Understandably, the term flexible material (10) can encompass numerous and varied materials including, but not limited to, plastic sheet; cloth; woven, braided, or twisted strands or fibers of plastic, metal, polysteel, or the like; net, web, or mesh made from such woven, braided, or twisted strands or fibers; used independently or used in various combinations and permutations.

Again referring primarily to FIGS. 1*b*, 2, 3, and 4, the invention can further include a material slide surface (14) coupled to a portion of the material support element (6). The material slide surface (14) slidly engages the flexible material (10) as the material support element (6) travels from a first position to a second position. As shown in FIG. 2, the flexible material (10) includes a net which slides upon a material slide surface (14) which encompasses a portion of the substantially spherical material support element (6). Depending upon various factors, including, for example, the weight of the flexible material (10), the strength of the flexible material (10), the size of any perforations (12) through the flexible material (10), the amount of power generated by the lift (1), or the like, the configuration of the material slide surface (14) (for example, spherical, ovoid, mushroom, saucer, or otherwise) and the kind of material (metal, plastic, Teflon®, wood, or the like) from which the material slide surface (14) can be numerous and varied to adjust the force of friction generated between the first surface of the flexible material (10) and the material slide surface (14). Proper selection of the configuration of the material slide surface (14) and the type of material from which the material slide surface (14) is made can reduce the force of friction to a level which allows the flexible material (10) to slidly engage the material slide surface (14) as the material support element (6) travels from a first position to a second position.

By slidly engaging the flexible material (10) with the material slide surface (14), forces transmitted to the flexible material (10) as the material support element travels from a first position to a second position can be less per unit area of flexible material (10); or can avoid acute application of force to a portion of the flexible material (10) which can occur when the flexible material (10) snags, or when the material support element (6) is attached to the flexible material (10) at a fixed location, or when the flexible material has a secured perimeter (15) of irregular shape.

Again referring primarily to FIG. 1*a*, at least one securement (16) can be utilized to establish a flexible material boundary (15) or perimeter. The flexible material boundary (15) can have any manner of configuration which secures a portion of the flexible material (10) at the flexible material boundary (15) at a material elevation which is lower than a material support element elevation established during travel of the material support element (6) between the first position and the second position.

Figure 3:
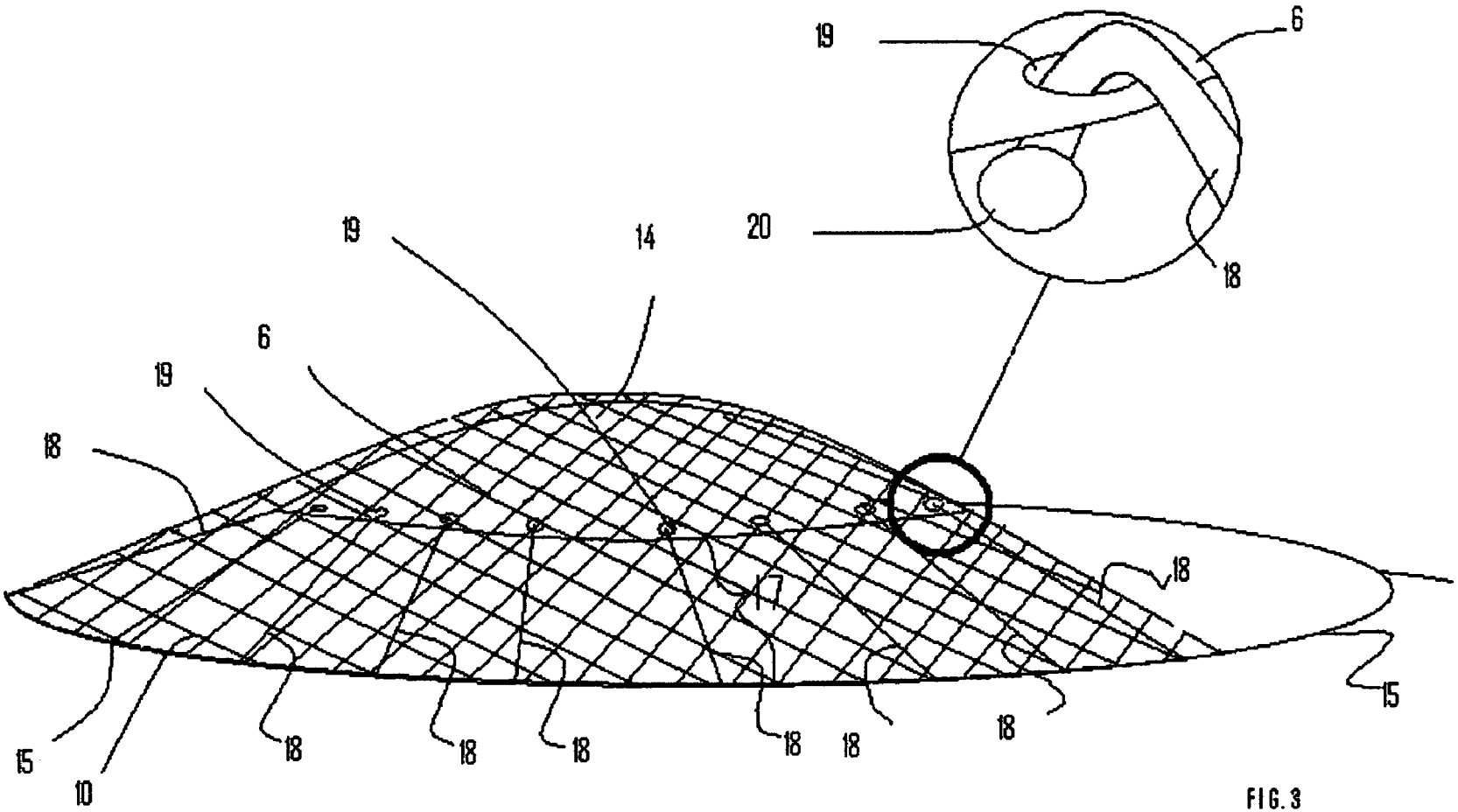
FIG. 3 shows an alternate embodiment of the invention which includes a material slide surface slidly engaged to a portion of the surface of a flexible material.
Figure 4:
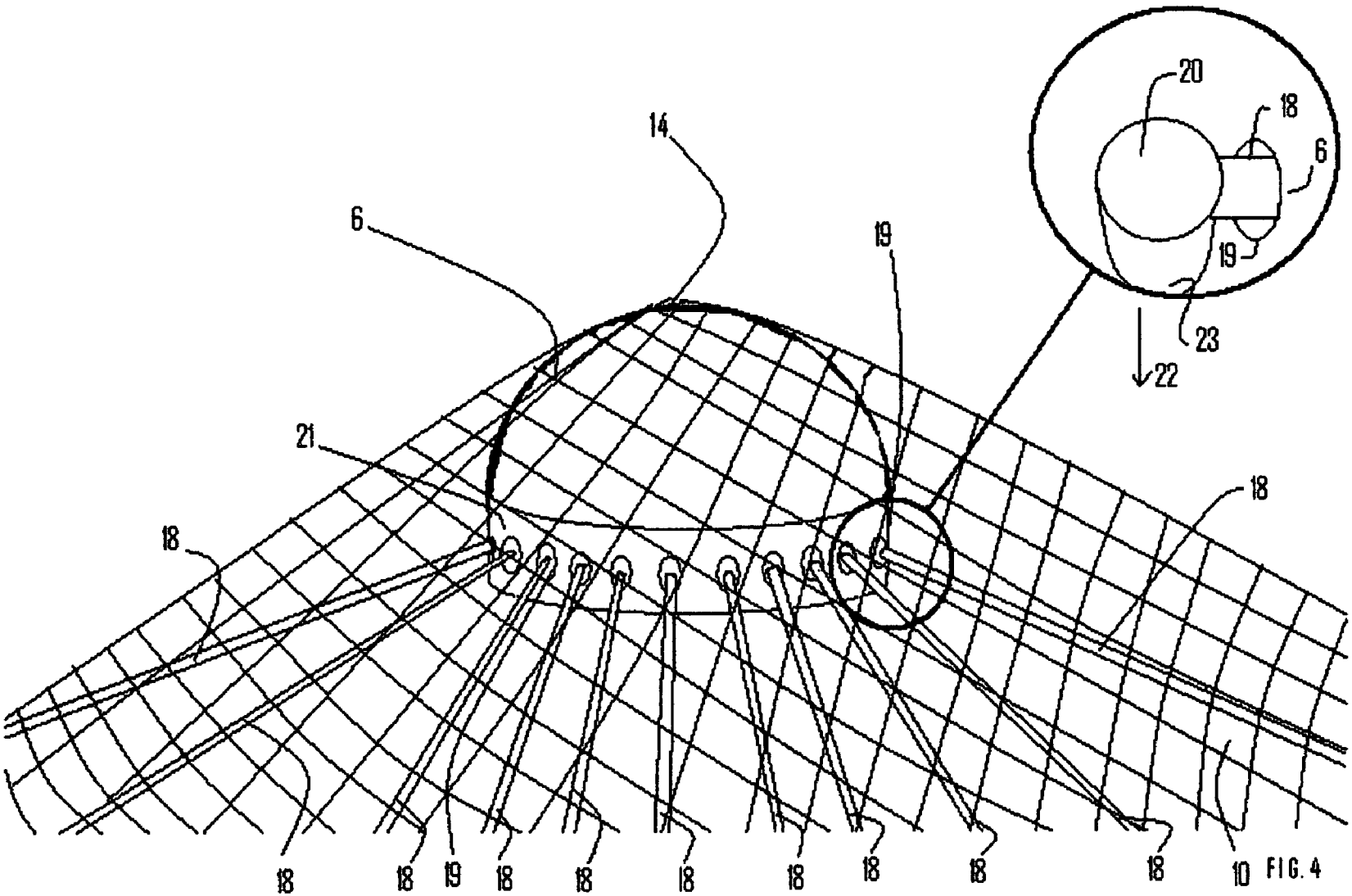
FIG. 4 shows an alternate embodiment of the invention which includes a material slide surface slidly engaged to a portion of the surface of a flexible material.

Now referring primarily to FIGS. 3 and 4, the object retrieval system can further include one or more material support lines (17) which slidly engage the flexible material (10) as the material support element (7) travels between the first position and the second position. The material support lines (17) can be made from numerous and varied materials such as twisted or braded steel, polysteel, plastic, or fiber strands. As to certain embodiments of the invention, the material support lines (17) can be coupled to the material support element (6) to provide variably adjusted tension on the material support line (17) as the material support surface (6) travels between a first position and a second position. A first non-limiting embodiment of the material support line (17) shown by FIG. 3, provides a line (18) which passes through a material support element aperture (19) and further provides a terminal element (20) having a configuration which will not pass through the material support element aperture (19). The material support lines (17) can have a length sufficiently long to compensate for travel of the material support element (6) from a first position to a second position. A second non-limiting embodiment of the material support line (17) is shown by FIG. 4, further provides an aperture location element (21) which locates the material support element aperture (19) at a location which facilitates attachment of the line (18) to the material support element (6), or locates the attachment of the line (18) to the material support element (6) at a location which will not snag or pull upon the flexible material during travel of the material support element from a first position to a second position.

A force (22) generated by a weight (23) whether discrete or integral to the terminal element (20) or by an resiliently elastic element, such as a spring, rubber cord, or the like, attached to the terminal element (20) can establish a desired level of tension in the line (18).

Objects (24) which become located on the second surface (13) of the flexible material (10) can traverse or move on the surface of a flexible material (10) under the influence of gravity. As the material support element (6) travels from a first position to a second position, a first portion of the flexible material (10) can be established at a higher elevation than the remaining portion of the flexible material (10). Objects (24) located on the second surface (13) of the flexible material (10) can move or traverse along the grade generated in the flexible material (10) from areas of higher elevation to areas of lower elevation.

The term "object" (24) is intended to encompass any object (24) which can move upon the second surface (13) of the flexible material (10) due to an difference in elevation of a first portion of the flexible material (10) and a second portion of the flexible material (10). As such, the term object encompasses spherical objects such as golf balls, tennis balls, baseballs, whiffle balls, ping pong balls, or the like, and also encompasses objects (24) which have ovoid shapes such as foot balls, or even objects of irregular shape such as fruit, dried fruit, fish, cans, debris, or the like.

As a non-limiting example, and again referring to FIGS. 1*a* and 1*b*, a plurality of securements (16) coupled to the flexible material (10) having perforations (12) establish a flexible material boundary (15) of irregular geometry around a water trap (25) located in a golf course. The lift (1) can be located at the bottom of the water trap (4) with the material support element (6) in the first position. With the material support element (6) established in the first position, the flexible material (10) is submerged beneath the surface of the water (5). Golfers utilizing the golf course hit golf balls (24) into the water trap (25) and the golf balls (24) become located on the second surface (13) of the flexible material (10). Periodically, the lift (3) is activated and the material support element(s) (6) travel to the second position. As the material support element(s) (6) travel from the first position to the second position, the first surface (11) of the flexible material (10) slidly engages the material slide surface (14). Forces generated in the flexible material (10) by elevating a portion of the flexible material (10) relative to the secured flexible material boundary (15) are disseminated or distributed throughout the flexible material (10) as the flexible material (10) slides over the material slide surface. At the second position, the material support element (6) has sufficiently elevated the flexible material (10) encompassed within the flexible material boundary (15) above the surface of the water (5). The difference in elevation between a least a portion of the flexible material boundary (15) and the elevation of the portion of the flexible material (10) engaged by the material support elements (6) can establish a grade sufficient to generate movement of the golf balls (24) located on the second surface (13) of the flexible material (10) toward at least a portion of the flexible material boundary (15). The golf balls (24) can then be collected at the flexible material boundary (15).

As a second non-limiting example, a plurality of securements (16) coupled to the flexible material (10) having perforations (12) establish a flexible material boundary (15) along a tennis net of a tennis court (not shown by the figures) with the remaining portion of the flexible material (10) responsive to a lift (1) established at a location on the court surface on the same side of the tennis net that the flexible material boundary (15) has been established. Tennis players serve balls (25) into the second surface (13) of the flexible material (10). Periodically, the lift (1) is activated and the material support elements (6) move from the first position to the second position to generate a sufficient grade in the flexible material (10) to generate movement of the tennis balls located on the second surface of the flexible material toward a collection location.

As can be easily understood from the foregoing, the basic concepts of the present invention may be embodied in a variety of ways. The invention involves numerous and varied embodiments of a vehicle payload conveyance system and methods of making and using such payload conveyance system.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "material support" should be understood to encompass disclosure of the act of "supporting material"—whether explicitly discussed or not—and, conversely, were there effectively disclosure of the act of "supporting material", such a disclosure should be understood to encompass disclosure of a "material support" and even a "means for supporting material" Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the vehicle payload conveyance systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A method of retrieving an object, comprising the steps of:

a. securing a boundary of a flexible material at a first elevation;

b. submerging a portion of said flexible material beneath the surface of an amount of water within a hollow;

c. slidably engaging a portion of said flexible material within said boundary with a material slide surface;

d. generating travel in said material slide surface from said first elevation to a second elevation; and e. altering configuration of said flexible material by travel of said material slide surface from said first elevation to said second elevation to generate movement of an object located on a surface of said flexible material toward said boundary of said flexible material.

2. A method of retrieving an object as described in claim 1, further comprising the step of establishing a plurality of perforations in said flexible material, wherein said plurality of perforations have a configuration which allows movement of said object on said surface of said flexible material without passing through said perforations.

3. A method of retrieving an object as described in claim 1, wherein said step of altering configuration of said flexible material by travel of said material slide surface from said first elevation to said second elevation to generate movement of an object located on said surface of said flexible material toward said boundary of said flexible material comprises raising said portion of said flexible material submerged beneath the surface of said amount of water within said hollow above the surface of said amount of water within said hollow to generate movement of at least one golf ball located on said surface of said flexible material toward said boundary of said flexible material.

4. A method of retrieving an object as described in claim 1, wherein said step of slidably engaging a portion of said flexible material within said boundary with a material slide surface comprises engaging a portion of said flexible material within said boundary with a plurality of material slide surfaces located a distance apart.

5. A method of retrieving an object as described in claim 3, further comprising the step of retrieving said at least one golf ball after movement of said golf ball toward said boundary of said flexible material.

* * * * *